US007215307B2

(12) United States Patent
Ochi et al.

(10) Patent No.: US 7,215,307 B2
(45) Date of Patent: May 8, 2007

(54) DRIVE UNIT OF SELF-LUMINOUS DEVICE WITH DEGRADATION DETECTION FUNCTION

(75) Inventors: Hideo Ochi, Tsurugashima (JP); Masami Tsuchida, Tsurugashima (JP); Shinichi Ishizuka, Tsurugashima (JP); Tsuyoshi Sakamoto, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 206 days.

(21) Appl. No.: 10/412,677

(22) Filed: Apr. 14, 2003

(65) Prior Publication Data

US 2004/0027320 A1 Feb. 12, 2004

(30) Foreign Application Priority Data

Apr. 15, 2002 (JP) ..... 2002-111464

(51) Int. Cl.
*G09G 3/30* (2006.01)

(52) U.S. Cl. ..... 345/77; 345/204

(58) Field of Classification Search ..... 345/45, 345/76–78, 204
See application file for complete search history.

(56) References Cited

U.S. PATENT DOCUMENTS 5,157,525 A * 10/1992 Eaton et al. ..... 345/87
5,216,504 A * 6/1993 Webb et al. ..... 348/190
5,903,246 A 5/1999 Dingwall
5,910,792 A * 6/1999 Hansen et al. ..... 345/74.1
6,320,325 B1 * 11/2001 Cok et al. ..... 315/169.3
6,424,326 B2 * 7/2002 Yamazaki et al. ..... 345/77
6,501,230 B1 * 12/2002 Feldman ..... 315/169.3
6,710,548 B2 * 3/2004 Kimura ..... 315/169.3
6,720,942 B2 * 4/2004 Lee et al. ..... 345/82
6,836,260 B2 * 12/2004 Cok ..... 345/45
2001/0013758 A1 8/2001 Tsuruoka et al.
2001/0028060 A1 10/2001 Yamazaki et al.
2004/0070558 A1 * 4/2004 Cok et al. ..... 345/76

FOREIGN PATENT DOCUMENTS

EP 1 291 840 A2 3/2003

* cited by examiner

*Primary Examiner*—Amr A. Awad
*Assistant Examiner*—Steven Holton
(74) *Attorney, Agent, or Firm*—Sughrue Mion, PLLC

(57) ABSTRACT

A drive unit which can prevent the decrease of the luminance of a self-luminous device due to degradation or a change is electric characteristic thereof. The drive unit has a semiconductor device having an electric characteristic almost the same as the that of the self-luminous device, and drives the semiconductor device in accordance with the frequency of light emission of the self-luminous device. The device generates a characteristic change detection signal indicating the degree of a change in an electric characteristic of the semiconductor device, and supplies the self-luminous device with a drive signal having a current level or a voltage level based on the characteristic change detection signal.

6 Claims, 6 Drawing Sheets

DRIVE UNIT OF SELF-LUMINOUS DEVICE WITH DEGRADATION DETECTION FUNCTION

BACKGROUND OF THE INVENTION

1. Field of the Invention

The present invention relates to a drive unit of a self-luminous device such as an organic electroluminescent device and the like.

2. Description of the Related Art

An image display device used in a portable terminal such as a hand-held mobile phone and the like requires a thin-profile display panel. As the conventional thin-profile display panel, a liquid crystal display panel is generally used. However, a display panel which is constituted of a matrix of a plurality of organic electroluminescent devices, hereinafter called organic EL devices, is more preferable as the image display device for portable terminal, because the display panel with the organic EL devices is not only thin but also lightweight.

Two methods are generally used to drive the organic EL device, those are, a current driving method and a voltage driving method. The organic EL device emits light, luminance of which is corresponding to a supplied current level, so that the drive unit adopting the current driving method keeps a current supplied to the organic EL device at a constant current level, and the drive unit adopting the voltage driving method keeps voltage applied to the organic EL device at a constant voltage level.

However, since the organic EL device is a self-luminous device, a current-luminance characteristic is varied depending on cumulative driving period and the operating environment. When the organic EL device is driven with a constant current, the luminance decreases as the driving time increases. On the other hand, the luminance increases as the ambient temperature increases, and it decreases as the ambient temperature decreases. When the organic EL device is driven with a constant voltage, the rate of variation in the luminance is larger than that in the case where the organic EL device is driven with the constant current. This is because the amount of the current flowing through the organic EL device changes as a consequence of the variation in impedance of the organic EL device depending on the driving time and the operating environment.

SUMMARY OF THE INVENTION

An object of the present invention is to provide a drive unit which can prevent a problem such as the lowering of luminance intensity of a self-luminous device such as an organic electroluminescent device and the like due to a change of a characteristic of the self-luminous device.

A drive unit according to the present invention drives a self-luminous device to make it emit light. The drive unit includes a semiconductor device having an electric characteristic substantially equal to an electric characteristic of the self-luminous device, a driver for driving the semiconductor device in accordance with the frequency of light emission from the self-luminous device, a characteristic change detector for generating a characteristic change detection signal indicating a degree of change in an electric characteristic of the semiconductor device, and a drive signal supply device for supplying the self-luminous device with a drive signal having a current level or a voltage level based on the characteristic change detection signal.

DETAILED DESCRIPTION OF THE INVENTION

Embodiments of the present invention will be hereinafter described in detail with reference to the accompanying drawings.

Figure 1:
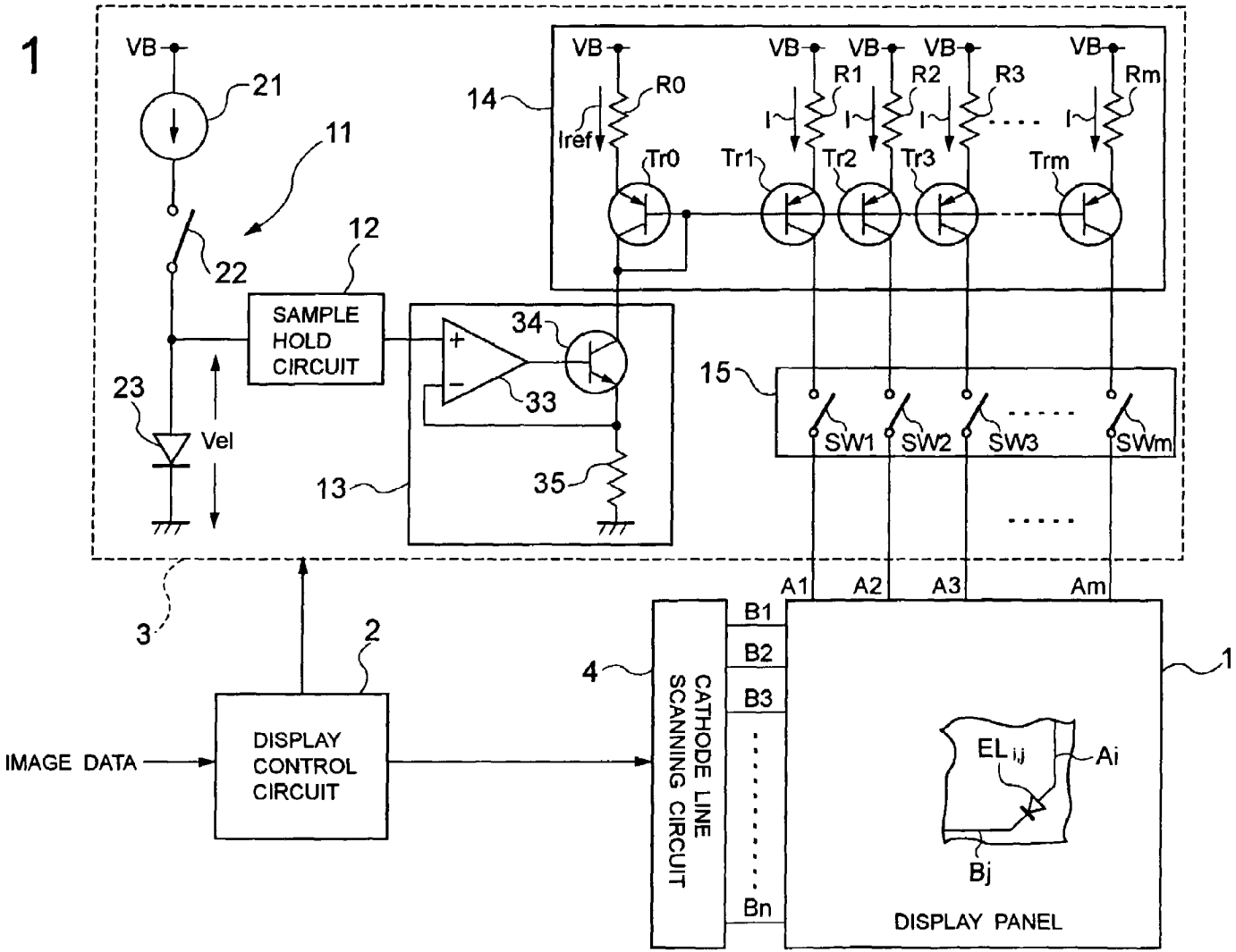
FIG. 1 is a block diagram showing the configuration of a drive unit driven by a current driving method according to the present invention.

FIG. 1 shows an embodiment of a drive unit of a display panel adopting a current driving method according to the present invention. This drive unit has a display panel 1, a display control circuit 2, an anode line driving circuit 3, and a cathode line scanning circuit 4. The display panel 1 is a matrix display panel on which an organic EL device (an organic electroluminescent device) is disposed at each intersection of a plurality of anode lines A1 to Am (m is a positive integer larger than or equal to 2) and a plurality of cathode lines B1 to Bn (n is a positive integer larger than or equal to 2).

The display control circuit 2, consisting of a CPU, controls the anode line driving circuit 3 and the cathode line scanning circuit 4, so that an image based on input image data is displayed on the display panel 1 in accordance with a line sequential scanning method. The display control circuit 2 issues a scanning command to the cathode line scanning circuit 4 in synchronization with predetermined scanning timing, and simultaneously issues a driving command to an after-mentioned switch circuit 15 in the anode line driving circuit 3.

The anode line driving circuit 3 is connected to each of the anode lines A1 to Am of the display panel 1, and selectively supplies the anode lines A1 to Am with a driving current in response to the driving command from the display control circuit 2. The cathode line scanning circuit 4 is connected to each of the cathode lines B1 to Bn. The cathode line scanning circuit 4 chooses any one of the cathode lines B1 to Bn in predetermined order in response to the scanning command from the display control circuit 2, and applies a predetermined scanning voltage (ground voltage, for example). The organic EL device emits light, when the predetermined voltage is applied to the connected cathode line and the organic EL device itself is supplied with the driving current via the anode line.

The anode lines driving circuit 3 is provided with a degradation detection circuit 11, a sample hold circuit 12, a current supply circuit 13, a current mirror circuit 14, and the switch circuit 15.

The degradation detection circuit 11, as an example of the characteristic change detection circuit, which has a constant current generator 21, a switch 22, and an organic EL device 23, outputs a voltage Ve1 indicating degree of degradation of the organic EL device 23 as a degradation detection signal which typically constitutes the characteristic change detection signal. The degradation detection circuit 11 may be driven by a voltage generator via an appropriate resistor instead of the constant current generator 21. The EL device 23 has the same electrical characteristics as the EL devices of the display panel 1. The EL device 23 is disposed inside the display panel 1 in order to be placed in the same operating environment as the display panel 1, or disposed in the vicinity of the display panel 1. It is preferable that the EL device 23 is disposed in a position where it is exposed to outside light as with the display panel 1.

A power supply voltage VB is applied to one end of the constant current generator 21, and the other end is connected to an anode of the EL device 23 via the switch 22. A cathode of the EL device 23 is connected to ground. An anode voltage of the EL device 23 is output as a degradation level voltage. The switch 22 is turned on and off in accordance with usage of the display panel 1, namely a lighting rate of each EL device of the display panel 1. The EL device 23, for example, is turned on while the display panel 1 is driven, and is turned off at all other times. Switching of the switch 22 is controlled by the display control circuit 2.

The sample hold circuit 12 holds the degradation level voltage (the degradation detection signal) output from the degradation detection circuit 11 with predetermined timing, and outputs it to the current supply circuit 13. When the switch 22 is ON, for example, the sample hold circuit 12 outputs the degradation level voltage just as it is, and when the switch 22 is OFF the sample hold circuit 12 holds and keeps on outputting the degradation level voltage at just a moment before the switching. The current supply circuit 13, which includes a differential amplifier 33, an NPN transistor 34, and a resistor 35, constitutes a voltage follower circuit. In other words, a positive input terminal of the differential amplifier 33 is supplied with an output voltage of the sample hold circuit 12, and an output terminal thereof is connected to a base of the transistor 34. An emitter of the transistor 34 is connected to ground via the resistor 35. A connection line between the emitter and the resistor 35 is connected to a negative input terminal of the differential amplifier 33. The differential amplifier 33 makes a voltage across the resistor 35 equal to a hold voltage supplied from the sample hold circuit 12 due to its circuitry configuration, so that a collector current of the transistor 34 is controlled corresponding to the hold voltage of the sample hold circuit 12. The collector current is supplied to the current mirror circuit 14 as a reference current Iref.

The current mirror circuit 14 includes m+1 paired resistors R0 to Rm and PNP transistors Tr0 to Trm. The power supply voltage VB is applied to an end of each resistor R0 to Rm. The other end of the resistor R0 is connected to an emitter of the PNP transistor Tr0, and both a base and a collector of the transistor Tr0 are connected to a collector of the transistor 34 of the current supply circuit 13. A common connection line between the base of the transistor Tr0 and the collector thereof is connected to a base of each transistor Tr1 to Trm. Emitters of the transistors Tr1 to Trm are connected to the other ends of the corresponding resistors R1 to Rm, respectively, and collectors thereof are connected to the switch circuit 15. In the current mirror circuit 14 with the above configuration, it is possible to feed a current I through each of the resistors R1 to Rm and emitter-to-collector of the transistors Tr1 to Trm. The amount of the current I is proportional to the reference current Iref flowing through the resistor R0 and emitter-to-collector of the transistor Tr0.

The switch circuit 15 has m units of switches SW1 to SWm, and the switches SW1 to SWm are disposed between the current mirror circuit 14 and the anode lines A1 to Am of the display panel 1, respectively. Each of the switches SW1 to SWm is turned on and off in response to the driving command described above.

In the drive unit with this configuration, since the switch 22 of the EL device 23 is turned on in accordance with emission time of each EL device of the display panel 1, degradation in characteristics of the EL device 23 is almost equal to average degradation of each EL device of the display panel 1. A terminal voltage Ve1 of the EL device 23 which is corresponding to the impedance thereof is held in the sample hold circuit 12.

While the switch 22 is ON, the sample hold circuit 12 updates and holds the terminal voltage Ve1 of the EL device 23 with predetermined timing, and then outputs it. The voltage held by the sample hold circuit 12 is applied to the current supply circuit 13, and a voltage equal to the terminal voltage Ve1 is applied to the resistor 35. When resistance of the resistor 35 is R35, the current Iref, which can be expressed as Ve1/R35, runs through the resistor R0, emitter-to-collector of the transistor Tr0, collector-to-emitter of the transistor 34, and the resistor 35. Suppose that a switch SWi (i is any number from 1 to m) out of the switches SW1 to SWm of the switch circuit 15 is turned on in response to the driving command from the display control circuit 2, and a cathode line Bj (j is any number from 1 to n) is selected in response to the scanning command. The current I an amount of which is proportionate to the reference current Iref passes through a resistor R1 and emitter-to-collector of a transistor Tri, and flows into ground through the switch SWi, an anode line Ai, an EL device ELi,j, and a cathode line Bj. Thus, the EL device ELi,j emits light.

The terminal voltage Ve1 of the EL device 23 is varied with degradation in each EL device of the display panel 1, because when each EL device of the display panel 1 is degraded, the EL device 23 is also degraded in like manner. In other words, the more degraded an organic EL device, the higher internal impedance of the organic EL device becomes, and the lower luminance becomes. Thus, the terminal voltage Ve1 increases in accordance with the degradation in each EL device of the display panel 1. The terminal voltage Ve1 is the degradation detection signal indicating degree of degradation in the EL device 23. When the terminal voltage Ve1 increases, the current Iref increases in accordance with variation of the terminal voltage ΔVe1. The current I increased in proportion to increase in the current Iref passes through the EL device ELi,j. Therefore, increase in the current I compensates lower luminance of the EL device ELi,j due to the degradation thereof, so that luminance of the EL device ELi,j is prevented from being lowered.

The same is true in a case where a plurality of switches out of the switches SW1 to SWm are turned on (including a case where all switches are selected) and a plurality of EL devices connected to the cathode line Bj simultaneously emit light. In other words, when the plurality of switches out of the switches SW1 to SWm are turned on, the current I flows into the EL devices through each anode line corresponding to the plurality of switches which has been turned on. The amount of the current I includes compensation for lower luminance due to the degradation of the EL device, so that luminance is prevented from being lowered in each EL device through which the current I passes.

Figure 2:
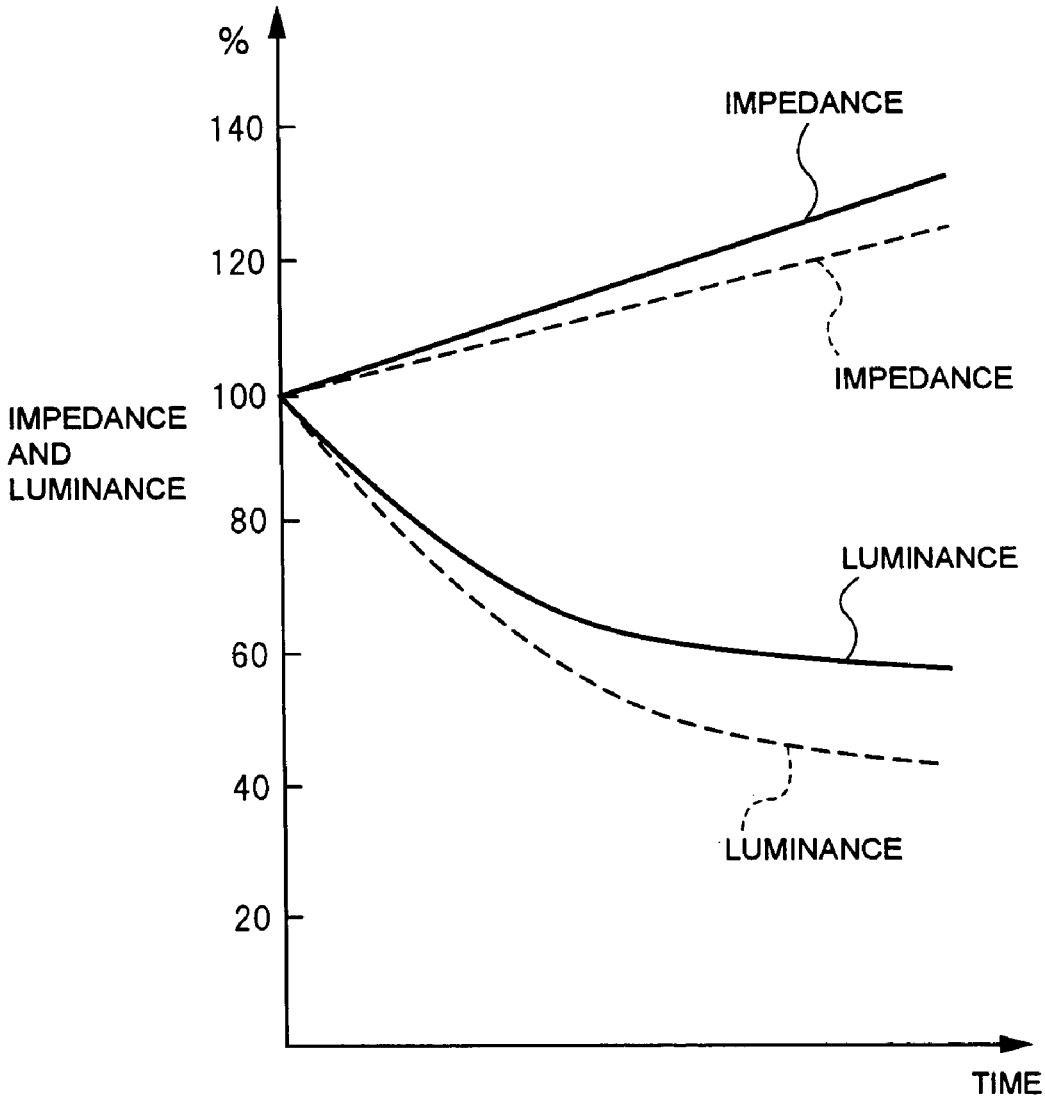
FIG. 2 is a graph showing variations in impedance and luminance of an organic EL device with a lapse of time.

FIG. 2 shows variations in impedance and in luminance of an organic EL device with respect to a lapse of driving time. In FIG. 2, solid lines are in a case of the drive unit according to the present invention, and broken lines are in a case of a conventional drive unit. It can be seen from characteristic curves in FIG. 2 that the luminance of the present drive unit is prevented from being lowered as compared with that of the conventional one, even if the variation in impedance of the present drive unit is larger than that of the conventional one.

Figure 3:
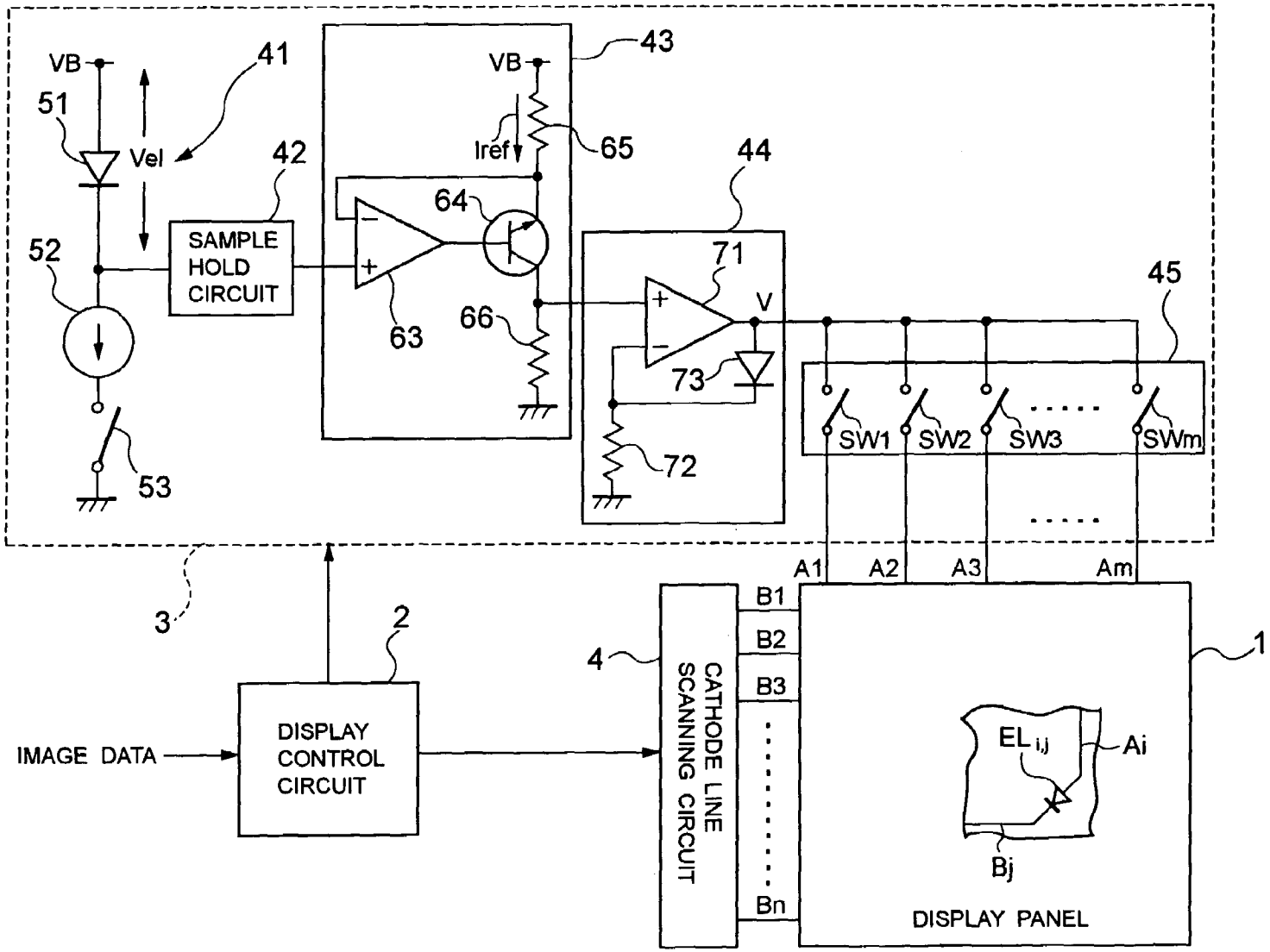
FIG. 3 is a block diagram showing a drive unit adopting a voltage driving method according to the present invention.

FIG. 3 shows another embodiment of a drive unit of the display panel adopting a voltage driving method according to the present invention. The drive unit is provided with the display panel 1, the display control circuit 2, an anode line driving circuit 3, and the cathode line scanning circuit 4, as in the case of the drive unit shown in FIG. 1. The anode line driving circuit 3 has a different configuration from that of FIG. 1. Referring to FIG. 3, the anode line driving circuit 3 includes a degradation detection circuit 41, a sample hold circuit 42, a voltage generator circuit 43, a monitor circuit 44, and a switch circuit 45. The degradation detection circuit 41 includes an organic EL device 51, a constant current generator 52, and a switch 53. The organic EL device 51, the constant current generator 52, and the switch 53 are connected in series in order. The power supply voltage VB is applied to an end of the series circuit, that is, an anode of the organic EL device 51, and the other end of the series circuit in the switch 53 side is connected to ground. As in the case of the organic EL device 23 and the constant current generator 21 in the driving device of FIG. 1, it is preferable that the EL device 51 has the same characteristics as each EL device of the display panel 1, and the constant current generator 52 may be a resistor. The switch 53, as in the case of the switch 22, is turned on and off in response to the usage of display panel 1, namely the lighting rate of each EL device of the display panel 1. A degradation level voltage Ve1 (a degradation detection signal) which is applied to a cathode of the organic EL device 51 connected to the constant current generator 52 is supplied to the sample hold circuit 42.

The sample hold circuit 42 holds the degradation level voltage Ve1 output from the degradation detection circuit 41 with predetermined timing, and outputs it to the voltage generator circuit 43. The voltage generator circuit 43, which includes a differential amplifier 63, an NPN transistor 64, and resistors 65 and 66, constitutes a voltage follower circuit. In other words, a positive input terminal of the differential amplifier 63 is supplied with an output voltage from the sample hold circuit 42, and an output terminal thereof is connected to a base of the transistor 64. An emitter of the transistor 64 is connected to a line of a power supply voltage VB via the resistor 65. A connection line between the emitter and the resistor 65 is connected to a negative input terminal of the differential amplifier 63. A collector of the transistor 64 is connected to ground via the resistor 66. According to the above-mentioned configuration of circuitry, the differential amplifier 63 makes a voltage across the resistor 65 equal to a hold voltage supplied from the sample hold circuit 42, so that a collector current of the transistor 64 is controlled corresponding to the hold voltage of the sample hold circuit 42. Since the collector current flows into ground through the resistor 66 as the reference current Iref, a voltage across the resistor 66 is generated corresponding to the current Iref. The voltage is applied to the monitor circuit 44.

The monitor circuit 44 includes a differential amplifier 71, a resistor 72, and an organic EL device 73. An output voltage from the voltage generator circuit 43 is supplied to a positive input terminal of the differential amplifier 71, and a negative input terminal is connected to ground through the resistor 72. The organic EL device 73, which is connected between an output terminal of the differential amplifier 71 and the negative input terminal, constitutes a feedback circuit of the differential amplifier 71. The organic EL device 73 is provided as an emission monitor device. The differential amplifier 71 amplifies the output voltage from the voltage generator circuit 43 with a gain, which is based on a ratio between the forward resistance of the organic EL device 73 and the resistance of the resistor 72, in order to output a driving voltage V. Since the forward resistance of the organic EL device 73 becomes large with a lapse of driving time, the gain of the differential amplifier 71 also increases. The driving voltage V output from the monitor circuit 44 is applied to the switch circuit 45.

The switch circuit 45, as with the above-mentioned switch circuit 15, has m units of switches SW1 to SWm which are disposed between the monitor circuit 44 and the anode lines A1 to Am of the display panel 1.

In the drive unit with this configuration, the sample hold circuit 42 updates and holds the terminal voltage Ve1 of the EL device 51 as the degradation level voltage with predetermined timing and outputs it, while the switch 53 is ON. The voltage held by the sample hold circuit 12 is supplied to the voltage generator circuit 43, and a current Iref which is proportionate to the terminal voltage Ve1 flows into ground through emitter-to-collector of the transistor 64 and the resistor 66. When resistance of the resistor 65 is R65, the current Iref can be expressed as Ve1/R65. A collector voltage of the transistor 64 is generated corresponding to the current Iref as the driving voltage V through the monitor circuit 44. The driving voltage V is applied to the EL device 73 for monitoring and makes the EL device 73 emit light. The driving voltage V is applied to any EL device of the display panel 1 through any of switches SW1 to SWm, which is turned on, in the switch circuit 45.

Suppose that a switch SWi (i is any number from 1 to m) out of the switches SW1 to SWm in the switch circuit 45 is turned on in response to the driving command from the display control circuit 2, and a cathode line Bj (j is any number from 1 to n) is selected in response to the scanning command. In this case, the driving voltage V is applied to an EL device ELi,j via the switch SWi, so that a current flows into ground through the switch SWi, an anode line Ai, the EL device ELi,j, and the cathode line Bj. Thus, the EL device ELi,j emits light.

When each EL device of the display panel 1 is degraded, the EL device 51 is also degraded in like manner, so that the terminal voltage Ve1 of the EL device 51 is varied in accordance with degradation in each EL device of the display panel 1. In other words, the more degraded an organic EL device, the higher internal impedance the organic EL device has, and the lower luminance becomes. Thus, the terminal voltage Ve1 increases in accordance with the degradation in each EL device of the display panel 1. When the terminal voltage Ve1 increases, the current Iref also increases in accordance with variation in the terminal voltage ΔVe1. The driving voltage V increased in proportion to an increase in the current Iref is applied to the EL device ELi,j. Therefore, an increase in the driving voltage compensates for a decrease in the luminance of the EL device ELi,j due to the degradation thereof, so that the luminance of the EL device ELi,j is prevented from being lowered.

The same is true in a case where a plurality of switches out of the switches SW1 to SWm are turned on (including a case where all switches are selected) and a plurality of EL devices connected to the cathode line Bj simultaneously emit light. When the plurality of switches out of the switches SW1 to SWm are turned on, the driving voltage V is applied to the plurality of EL devices through each anode line corresponding to the plurality of switches which has been turned on.

Figure 4:
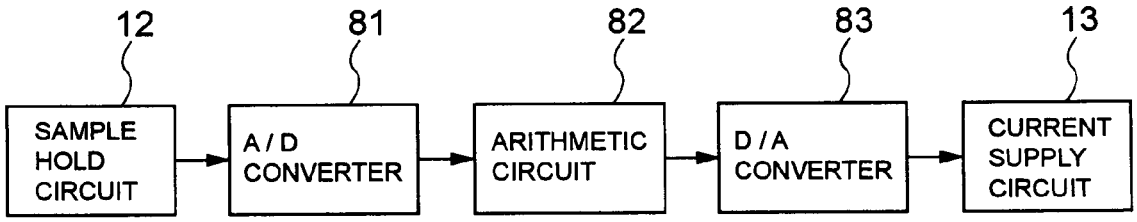
FIG. 4 is a block diagram showing a part of a drive unit according to another embodiment of the present invention.
Figure 5:
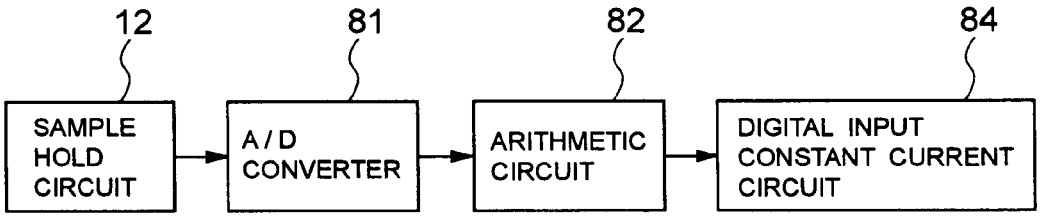
FIG. 5 is a block diagram showing a part of a drive unit according to still another embodiment of the present invention.
Figure 6:
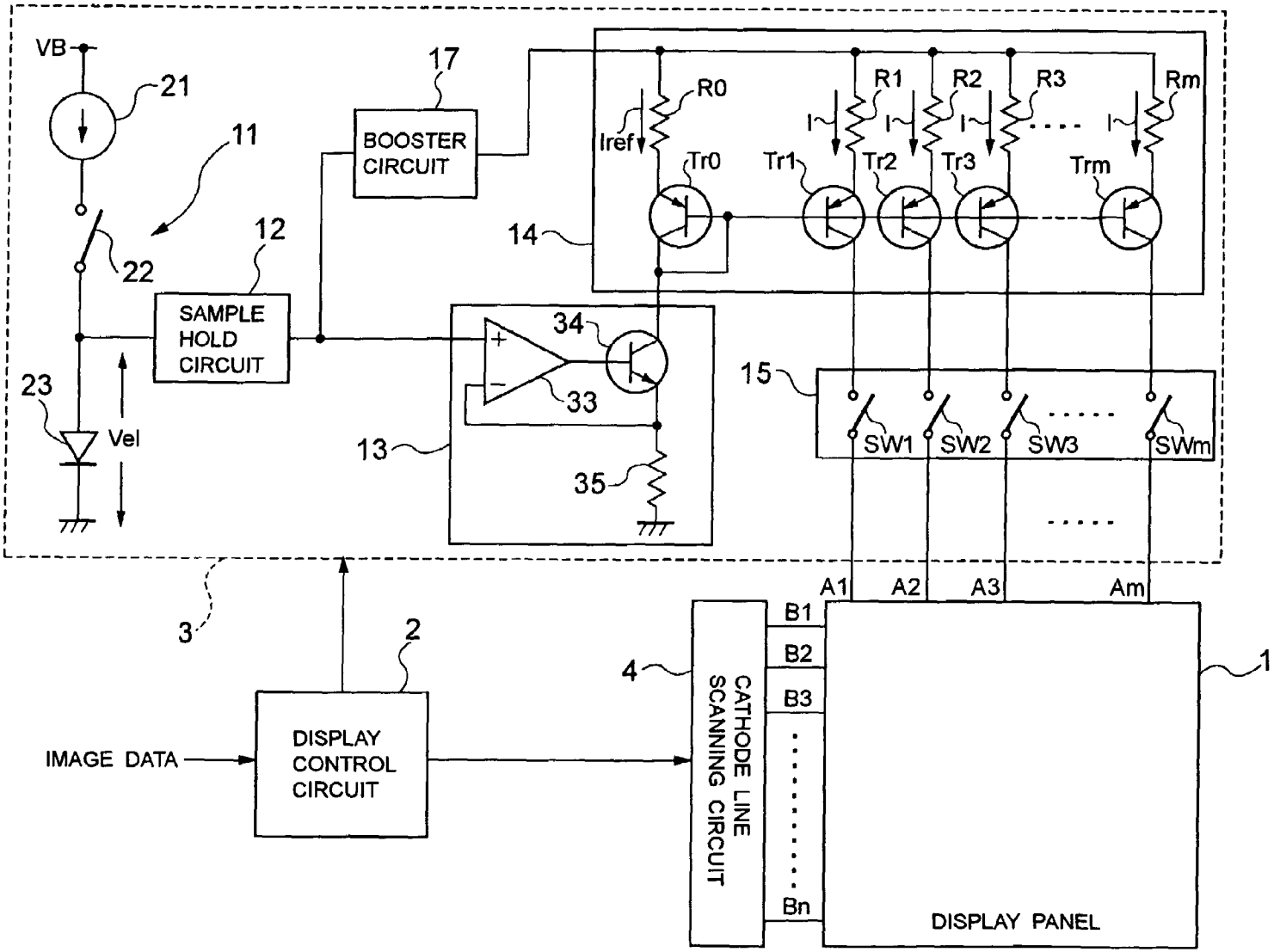
FIG. 6 is a block diagram showing the configuration of a drive unit adopting the current driving method according to still another embodiment of the present invention.

In order to cope with the situation that variation in impedance of the EL device is not linearly proportionate to variation in the luminance with respect to a lapse of driving time, as shown in FIG. 4, the drive unit may be provided with an analog-to-digital converter 81 for analog-to-digital conversion of an output voltage from the sample hold circuit 12, an arithmetic circuit 82 for nonlinearly converting an output digital value from the analog-to-digital converter 81 using a predetermined table, and a digital-to-analog converter 83 for digital-to-analog conversion of an output value from the arithmetic circuit 82. In the configuration shown in FIG. 4, an output voltage from the digital-to-analog converter 83 is applied to the current supply circuit 13. Furthermore, as shown in FIG. 5, a constant current circuit 84 with digital input may be provided instead of the digital-to-analog converter 83 and the current supply circuit 13 shown in FIG. 4.

In the drive unit of the display panel according to the present invention, it is also possible to supply a suitable driving voltage for the impedance of the EL device by means of using an output voltage from a booster circuit 17 as the power supply voltage. Thus, it is possible to keep power consumption of a current driving circuit to a minimum. In a conventional drive unit adopting the current driving method, a power supply voltage for a display panel has a margin of approximately 5 volts in consideration of variation in impedance of EL devices. The voltage margin becomes heat loss in a driving circuit, and the heat loss brings about increase in power consumption. In the drive unit according to the present invention, however, the increase in power consumption is prevented due to the booster circuit 17.

A further embodiment of the drive unit according to the present invention will be described with reference to FIG. 7.

Figure 7:
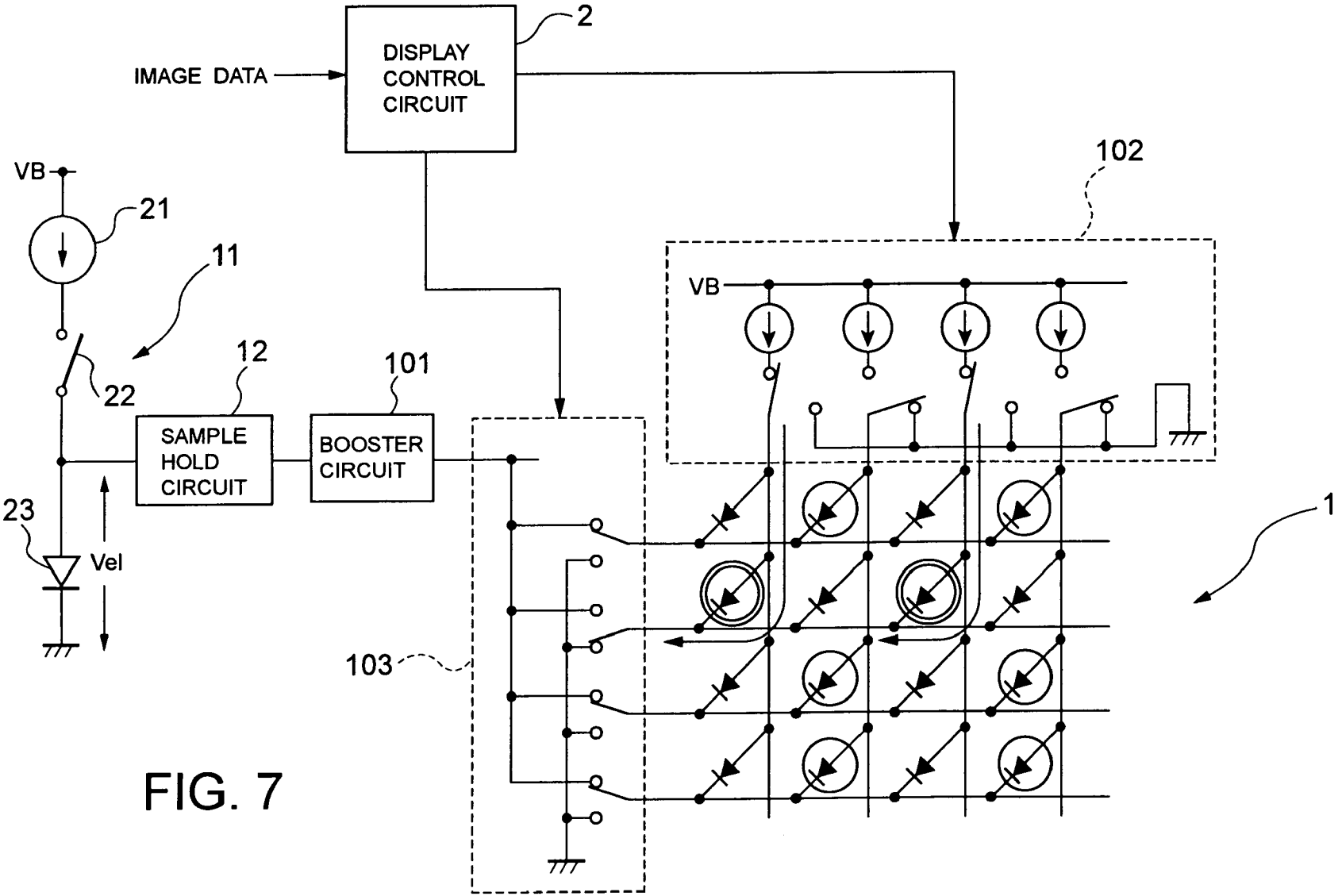
FIG. 7 a block diagram showing a further embodiment of the drive unit according to the present invention.

In FIG. 7, circuit elements or parts that corresponds to those depicted in the preceding drawings are denoted by like reference numerals and the explanation thereof will not be repeated.

In this embodiment, the output signal of the sample/hold circuit 12 is supplied to a booster circuit 101 whose output current is in turn supplied to a cathode drive circuit 103. The booster circuit 101 is analogous to the booster circuit 17 used in the first embodiment shown in FIG. 1, and generates a voltage higher than a potential applied to the cathode of the organic electroluminescent device driven to emit light, as explained later.

The plurality of anode lines of the display panel 1 are connected to an anode driver 102 that selectively supplies a drive current in response to the driving command from the display controller 2. The plurality of cathode lines of the display panel 1 are connected to a cathode driver 103 that selects one of the plurality of cathode lines in response to a scanning command from the display controller 2 and applies a scanning electric potential to the selected one of the scanning lines. As illustrated in FIG. 7, the anode drive circuit 102 has a plurality of switches, each of which connects the anode line to the drive current source or a ground potential. A second electric potential is set to be higher than the scanning potential, so that the second electric potential higher than the scanning electric potential is applied to cathode lines other than the cathode line of scanning row.

As a result, among the organic electroluminescent devices connected to the anode lines to which the drive current is supplied (in the illustrated example, the first and third anode lines from the left end), the devices other than the devices driven to emit light are prevented from being supplied with the drive current. In FIG. 7, the organic electroluminescent devices marked with the double circle are devices driven to emit light, and the devices marked with the single circle are devices that are reverse-biased by the application of the second electric potential of the scanning drive. In this way, the driving current is surely prevented from flowing through these devices marked with the single circle.

Thus, by the application of the present invention in driving structures using the so-called cathode reset method in which a second electric potential other than the drive potential is applied to the cathode of each of organic electroluminescent devices of non-lit rows, a sufficient current control function can be maintained even if the impedance of the organic electroluminescent device changes. Consequently, the advantageous effects of the so called cathode reset method, e.g., the reduction of electric power consumption of the display panel and the prevention of the crosstalk of the drive current between organic electroluminescent devices, can be surely maintained.

Furthermore, it is possible to adopt an arrangement in which the voltage of current control of the anode driver based on the output signal of the sample hold circuit 12 in each of the preceding embodiment is used in combination with the voltage control of the cathode driver based on the output voltage of the sample hold circuit 12 which has been explained referring to FIG. 7.

The present invention is applicable to both the drive unit of the display panel adopting the current driving method and that adopting the voltage driving method. The present invention is furthermore applicable not just to a passive drive unit, but also to an active drive unit. The present invention is applicable not just to a dot presentation panel described above, but also to a segment presentation panel.

The organic EL devices 23 and 51 in the respective embodiments described above are emission devices. However, the present invention is also applicable to a nonluminous organic semiconductor device which has equal electrical characteristics to the organic EL devices.

In each embodiment described above, an organic EL device is used as a self-luminous device. However, the self-luminous device is not limited to the organic EL device, but may be another luminous device luminance of which is proportionate to supplied current level.

As described above, the present invention can prevent lowered luminance of a self-luminous device due to degradation thereof.

This application is based on Japanese Patent Application No. 2002-111464 which is herein incorporated by reference.

What is claimed is:

1. A drive unit for driving a self-luminous device to make said self-luminous device emit light, said drive unit comprising:

a semiconductor device having an electric characteristic substantially equal to an electric characteristic of said self-luminous device;

a driver for driving said semiconductor device in accordance with the frequency of operating said self-luminous device;

a characteristic change detector for generating a characteristic change detection signal indicating a degree of characteristic change in said semiconductor device by detecting at least one of a voltage across or a current through said semiconductor device; and a drive signal supply device for supplying said self-luminous device with a drive signal having a current level or a voltage level based on said characteristic change detection signal, wherein said characteristic change detector comprises a sample hold circuit, said sample hold circuit detecting a voltage across said semiconductor device as said characteristic change detection signal.

2. The drive unit according to claim 1, wherein said drive signal supply device comprises:

a current supply circuit for outputting a reference current corresponding to an output voltage from said sample hold circuit; and a current mirror circuit for supplying said self-luminous device with a current having a level being proportionate to the reference current output from said current supply circuit as said drive signal.

3. The drive unit according to claim 1, wherein said sample and hold circuit is configured to:

supply said characteristic change detection signal to said drive signal supply device while said driver drives said self-luminous device; and holds the voltage present across said semiconductor device just before said self-luminous device is turned off, and supplies the held voltage as said characteristic change detection signal to the drive signal supply device while said driver does not drive said self-luminous device.

4. The drive unit according to claim 1, wherein said drive signal supply device comprises:

a booster circuit for boosting an output voltage from said sample hold circuit and outputting a boosted voltage to said drive signal supply device as a power source voltage;

a current supply circuit for outputting a reference current corresponding to the output voltage from said sample hold circuit;

a current mirror circuit for supplying said self-luminous device with a current having a level being proportionate to the reference current output from said current supply circuit as said drive signal.

5. The drive unit according to claim 1, wherein said drive signal supply device comprises:

an arithmetic part for performing a predetermined computation based on an output voltage from said sample hold circuit, and outputting a voltage in accordance with a result of the computation;

a current supply circuit for outputting reference current corresponding to the output voltage from said arithmetic part;

a current mirror circuit for supplying said self-luminous device with a current having a level being proportionate to the reference current output from said current supply circuit as said drive signal.

6. The drive unit according to claim 1, wherein said drive signal supply device comprises a circuit for applying a voltage having a level in accordance with an output voltage from said sample hold circuit to said self-luminous device as said drive signal.

* * * * *